United States Patent [19]

Gunther et al.

[11] 4,230,796

[45] Oct. 28, 1980

[54] HIGH SPEED LITHOGRAPHIC FILM ELEMENT

[75] Inventors: Herbert Gunther, Dreieich, Fed. Rep. of Germany; Herbert Blank, Darmstadt, Fed. Rep. of Germany

[73] Assignee: E. I. Du Pont De Nemours and Company, Wilmington, Del.

[21] Appl. No.: 945,061

[22] Filed: Sep. 22, 1978

[30] Foreign Application Priority Data

Jan. 18, 1978 [DE] Fed. Rep. of Germany ..... 2802016

[51] Int. Cl.[3] ..... G03C 1/06; G03C 1/28

[52] U.S. Cl. ..... 430/523; 430/264; 430/564; 430/949

[58] Field of Search ..... 96/66.3, 107, 95; 430/564, 204, 566, 603, 264, 611, 523, 631, 949, 448

[56] References Cited

U.S. PATENT DOCUMENTS

| | | | |
|---|---|---|---|
| 2,449,153 | 9/1948 | Urbach | 96/107 |
| 2,955,036 | 10/1960 | Dersch et al. | 96/109 |
| 3,068,100 | 12/1962 | Dersch | 96/109 |
| 3,201,243 | 8/1965 | Larson | 96/109 |
| 3,282,694 | 11/1966 | Luckey | 96/109 |
| 3,615,513 | 10/1971 | Haist et al. | 96/61 M |
| 3,615,519 | 10/1971 | Milton | 96/107 |
| 3,615,528 | 10/1971 | Huckstadt et al. | 96/107 |
| 3,708,302 | 1/1973 | Plakunov et al. | 96/107 |
| 3,765,901 | 10/1973 | Schellekens | 96/95 |
| 3,799,780 | 3/1974 | Suga | 96/66 R |
| 3,843,372 | 10/1974 | Jefferson | 96/109 |
| 3,869,289 | 3/1975 | Amering | 96/66.3 |
| 3,893,858 | 7/1975 | Wabnite | 96/22 |

FOREIGN PATENT DOCUMENTS 1387654 3/1975 United Kingdom .

OTHER PUBLICATIONS

Glafkides, Photographic Chemistry, Vol. 1, 1960 pp. 281–287, 315–316.

*Primary Examiner*—Mary F. Downey

[57] ABSTRACT

High speed litho film in which short-life development accelerators such as cysteine methyl ester and its analogues are incorporated into the silver halide emulsion layer.

8 Claims, No Drawings

HIGH SPEED LITHOGRAPHIC FILM ELEMENT

BACKGROUND OF THE INVENTION

This invention relates to a high speed lithographic (litho) film element comprising a film support containing one or more light-sensitive silver halide emulsions coated thereon.

The sensitometric curve which is characteristic of light-sensitive silver halide emulsions used in lithographic film elements conventionally has a sharp toe and high gradient or contrast. These elements also have a high top density and a very low fog. In order to achieve these results high chloride emulsions are conventionally employed.

These film elements are processed, after image exposure, in so-called "lith developers" which are based mainly on hydroquinone, have a low sulfite content and usually contain formaldehyde. These developers require a relatively long induction period prior to development, whereupon so-called "infectious development" occurs, giving rise to the specific sensitometric properties described above. These properties are necessary in order to achieve good dot quality, e.g., dots of high density and good edge sharpness as required for use in lithography.

Long induction periods are a serious drawback in this film/developer system. A large number of compounds have been reported in the prior art as accelerators for litho development and are said to reduce the induction period and thus increase the effective speed of the system. For example, onium compounds such as ammonium-, phosphonium- and sulfonium- compounds, pyridinium salts, and organic thiocompounds are disclosed as accelerators when added to the emulsions as reported in U.S. Pat. No. 3,785,822. These compounds are, however, not completely satisfactory. For example, the onium compounds either exhibit only a slight effect on the induction period or are not compatible with anionic wetting agents frequently used in these emulsions and form undesirable deposits with these wetting agents. Although the organic thiocompounds generally are useful in overcoming the induction period and increasing the system speed, they usually impair the dot quality and thus produce an unacceptable final image. Additionally, there is a tendency for the accelerators of the prior art to diffuse from the emulsion layer and to accumulate in the processing baths and deteriorate dot quality. As the accelerators accumulate, solids are formed by precipitation from the processing fluids. These solids also cause problems on the film surface and interfere with the dot quality in addition to causing sludge which affects processing conditions, especially in automatic machine processors. Thus, there is a pressing need for accelerators in the litho system which do not produce the serious side effects mentioned above.

SUMMARY OF THE INVENTION

The present invention answers this need by providing an element comprising a film support having one or more light-sensitive lithographic gelatino-silver halide emulsions coated thereon, said emulsion(s) containing a development accelerator of the general formula:

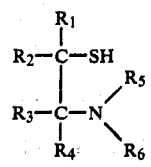

or a salt thereof, wherein each of $R_1$, $R_2$, $R_5$ and $R_6$ = H or alkyl of 1–5 carbon atoms, and each of $R_3$ and $R_4$ = H or —COOR, where R = alkyl of 1–5 carbon atoms. The element of this invention may also contain one or more light-insensitive layers in operative association therewith (e.g. as an underlayer and/or abrasion layer) and the accelerators of this invention may also be contained in one or more of these layers. The accelerators of this invention assist in reducing the induction period of image development and do not adversely affect dot quality of the final image. Especially useful results are achieved when these accelerators are used with dot sharpening agents.

DETAILED DESCRIPTION

In a preferred embodiment, one or more of the accelerators is used in combination with a conventional dot sharpening agent such as a polyalkylene oxide compound, especially polyethylene oxide compounds (PEO) and their derivatives. PEO compounds with a molecular weight range of 1,000 to 40,000 are suitable for use and those with a molecular weight of about 20,000 are particularly useful. Derivatives of PEO (e.g. the esters or ethers which become active when contacted by the alkali agents usually present in the developer solution and diffuse only at the point of reaction) may also be used. Other dot sharpening agents include poly-N-vinyl lactams, such as N-vinyl-pyrrolidone as well as 5- and 6-nitroindazole. The dot sharpening agents generally are used in amounts of 50 to 2,000 mg/mole of silver halide in the emulsion layer. Especially good results are achieved when the dot sharpening agent is incorporated into one of the intermediate layers between the film support of the system and the light-sensitive emulsion layer and when the accelerator of this invention is contained in said emulsion layer. Moreover, it has been found particularly efficacious to coat the emulsion in the form of a double coating with a thickness ratio of 1:1 to 1:9 and to add the dot sharpening agent to the thinnest of the emulsion layers.

Preferred accelerators of this invention are the methyl ester of cysteine, 2-amino-ethanethiol-1,2-dimethylamino-ethanethio-1, and their salts. The preparation of these compounds and others is well-known and is described by Houben-Weyl, 4th Edit., Vol IV, pp. 7–49. Additionally, most of these compounds are commercially available.

The accelerators of this invention are preferably added to the emulsion layer in concentration of 1 to 600 mg/mol of silver halide. However, emulsion concentrations of the different accelerators which are useful within the ambit of this invention can easily be determined by the skilled practitioner. The accelerators are usually added to the emulsion as an aqueous solution at some point prior to coating. Preferably, the solution containing the accelerator is added after emulsion sensitization with the other after additions.

To prevent overdevelopment fogging, a small amount of hydroquinone (e.g. 50 to 500 mg/mole of silver halide in the emulsion layer or layers) may be added to the emulsion layer or layers and/or to the auxiliary coatings associated with or contiguous to said layer or layers.

Lithographic emulsions useful in the practice of this invention are generally composed predominantly of silver chloride with the remainder being silver bromide. However, small amounts of silver iodide (e.g. 0.5 to 5 mole percent) may also be used. The emulsions generally contain at least 50 mole percent silver chloride and preferably 70 to 80 mole percent silver chloride, the remainder being silver bromide with or without the small amounts of silver iodide mentioned above. Silver halide emulsions with a core/shell structure as described in U.S. Pat. No. 4,070,190 are also suitable.

These emulsions can be prepared with gelatin or modified gelatins, or mixtures thereof, as the colloidal binder. Additionally, the binders may be partially replaced with mixed polymers (e.g. ethyl acrylate polymers and the like). The emulsions are usually brought to their optimum sensitivity by treatment with sulfur and gold compounds as well-known. Additionally, these emulsions can contain optical sensitizers to extend the spectral sensitivity, and usual stabilizers, hardeners, coating and wetting aids, etc.

As previously mentioned, the elements representing this invention can also contain light-insensitive auxiliary coatings which can be located between the film support and light-sensitive emulsion layer (under-layers) and also can be applied as over-coats (e.g. abrasion layers); in fact this is preferred. These layers are generally coated from aqueous gelatin solutions with or without additives such as hardeners, coating aids, etc.

Excellent line and raster images with superior dot quality can be produced by exposing and developing the elements of this invention. Optimum sensitivity and dot quality are achieved within a short period of development compared to conventionally prepared elements (e.g. without accelerators or with the accelerators of the prior art). Thus, the induction period is considerably reduced in the system of this invention. Presumably the superior effectiveness of the development accelerators of this invention is based on the fact that they exhibit a strong accelerating effect at the beginning of the development process, yet lose their effectiveness at the end of the process by decomposition or by a 1,4-addition to the intermediate quinone product from the developing agent hydroquinone. Hence the dot sharpening agents referred to above can be most advantageously added at this time, thus enhancing the dot quality.

It was surprising that these compounds would behave as development accelerators, since similar compounds, such as cysteine, have been employed in prior art emulsion systems without any noted accelerating effect.

This invention will now be illustrated by the following examples.

EXAMPLE 1

A conventional silver chlorobromide lithographic emulsion with a silver chloride content of about 75 mole % was prepared and divided into four parts. The development accelerator 2-amino-ethanethiol-1-hydrochloride was added in varying amounts to each part as shown below:

| Sample | Amt. of Accelerator (mg/mole silver halide) |
|---|---|
| A | none—control |
| B | 2 |
| C | 4 |
| D | 8 |

Each of these emulsion samples was coated on a conventional polyethylene terephthalate film base support to a coating weight of about 10 mg/m$^2$ silver nitrate. After drying, a conventional gelatin abrasion layer was applied to each and also dried. Sample strips from each coating were exposed by passage through and contact with a Raster with an exposure time of 4 seconds at 20 Lux using a conventional contact unit containing a Punctiform glow lamp at distance of 80 cm. The exposed strips were then developed in a conventional automatic roll developing machine for 2 min. at 27° C. in a developer of the following composition:

| | |
|---|---|
| Distilled water | 800 ml. |
| Hydroquinone | 18 g. |
| $K_2CO_3$ (anhydr.) | 60 g. |
| Sodium formaldehyde bisulfite | 50 g. |
| KBr | 1.5 g. |
| $Na_2CO_3$ (anhydr.) | 4 g. |
| Boric Acid | 10 g. |
| Polyethylene glycol (M.W. 1500) | 4 g. |
| Water to 1 liter (pH = 10.4) | |

The strips were subsequently fixed, rinsed and dried and the obtained results are summarized in Table 1. In this and the subsequent tables, the sensitivity of the comparative sample attained with the respectively given development time is set equal to 100. Sensitivity itself is determined with a density of 0.30 over the base+fog.

The gamma values obtained represented the rise of the characteristic film curve obtained between 0.3 and 3 density over the base+fog. To determine the dot quality, the dots are evaluated by microscopic examination of the Raster reproduction, as well as by microsensitometric measurements of edge sharpness, dot size, light permeability of small dots, dot structure and the like and are arranged according to a numerical scale from 1 to 6, based on their subjective evaluation. A dot quality of up to 2 indicates very good, i.e., all the above listed features of a good dot are present. A dot quality up to 3.5, for all practical reasons, is well usable while a dot quality of 4 or more is unsatisfactory to unusable.

TABLE 1

| Sample | Relative Sensitivity (2 min. at 27° C.) | Dot Quality |
|---|---|---|
| A | 100 | 2 |
| B | 120 | 2 |
| C | 140 | 2.5 |
| D | 200 | 3 |

The results show that the dot quality is practically unimpaired or is only very slightly imparied by the rise in sensitivity.

EXAMPLE 2

Emulsion described in Example 1 was divided into 5 parts. The following ingredients were added to each part:

| Sample | Additives | Amount (mg/mole of Silver Halide) |
|---|---|---|
| A | None-control | |
| B | Polyethylene oxide (m.w. ~20,000) | 200 |
| C | Polyethylene oxide (m.w. ~20,000) | 200 |
| | Methyl ester of L-cysteine-1-hydro-chloride | 67 |
| D | Polyvinyl pyrrolidone (m.w. ~30,000) | 80 |
| | Methyl ester of L cysteine-1-hydro-chloride | 67 |
| E | Polyethylene oxide (m.w. ~20,000) | 200 |
| | 2-dimethylamino-ethanethiol-1-hydro-chloride | 4 |

The emulsions were coated, dried, overcoated, exposed, developed, fixed and dried as described in Example 1 with the following results.

TABLE 2

| Sample | Relative Sensitivity (1¾ min. at 27° C.) | Gamma | Fog | Dot Quality 5% | 50% | 95% |
|---|---|---|---|---|---|---|
| A | 100 | 15.5 | 0.01 | 3 | 2 | 3 |
| B | 81 | 15.0 | 0.01 | 2.5 | 2 | 2.5 |
| C | 138 | 16.0 | 0.01 | 2 | 1.5 | 2 |
| D | 141 | 15.5 | 0.01 | 2 | 1.5 | 2.5 |
| E | 128 | 15.0 | 0.01 | 2 | 1.5 | 2.0 |

In this table the dot quality ratings are shown for dots ranging from 5–95% based on the area covered by developed silver using a conventional 133 lines per inch magenta halftone screen backed by a continuous wedge for exposure. It is seen from the table that the dot quality is not impaired by the development accelerator described.

EXAMPLE 3

An emulsion as described in Example 1 was prepared and divided into 3 parts. The following ingredients were added to each part:

| Sample | Additive | Amount (Mg/mole of Silver Halide) |
|---|---|---|
| A | None-control | |
| B | Polyethylene oxide (M.W. ~20,00) | 200 |
| C | Polyethylene oxide (M.W. ~20,000) | 200 |
| | Methyl ester of L-cysteine | 64 |

The samples were coated, overcoated, dried, exposed, developed, fixed and washed as previously described. The development time was varied for each sample as shown below. The following results were obtained.

TABLE 3

| Development time (s) | Sample | Relative Sensitivity | Fog | Dot Quality 5% | 50% | 95% |
|---|---|---|---|---|---|---|
| 90 | A | 55 | 0.01 | 3.5 | 3 | 3 |
| | B | 43 | 0.01 | 2.5 | 2 | 2.5 |
| | C | 74 | 0.01 | 2.5 | 2 | 2.5 |
| 105 | A | 73 | 0.01 | 3.5 | 3 | 2.5 |
| | B | 60 | 0.01 | 2.5 | 2 | 2.5 |
| | C | 100 | 0.01 | 2 | 1.5 | 2 |
| 120 | A | 100 | 0.02 | 4 | 3 | 3.5 |
| | B | 75 | 0.02 | 3 | 2 | 2.5 |
| | C | 133 | 0.02 | 2 | 1.5 | 2 |
| 135 | A | 123 | 0.02 | 5 | 3.5 | 4 |
| | B | 100 | 0.02 | 3.5 | 2.5 | 3 |
| | C | 166 | 0.02 | 2.5 | 2 | 2 |
| 150 | A | 153 | 0.03 | 5.5 | 4 | 4 |
| | B | 120 | 0.02 | 4 | 3 | 3 |
| | C | 213 | 0.02 | 3.5 | 3 | 3 |

In this example, the sensitivity of Sample A achieved after 2 min developing time=100.

It is clearly seen from this table that the good dot quality remains constant over a longer development time.

EXAMPLE 4

An emulsion as described in Example 1 was prepared, divided into 5 parts and the following ingredients added thereto:

| Sample | Additive | Amount (mg/Mole of Silver Halide) |
|---|---|---|
| A | None-control | |
| B | Polyethylene oxide (M.W. ~20,000) | 200 |
| C | Polyethylene oxide (M.W. ~20,000) | 200 |
| | 2-amino-ethanethiol-1-hydrochloride | 4 |
| D | Polyethylene oxide (M.W. ~20,000) | 200 |
| | 2-mercapto-1-methyl-imidazole | 4 |
| E | Polyethylene oxide (M.W. ~20,000) | 200 |
| | L-cysteine | 100 |

The samples were coated, exposed, developed, fixed and dried according to Example 1. Evaluation of the test strips indicated the following results:

TABLE 4

| Sample | Relative Sensitivity 2¾ min. at 27° C. | Gamma | Fog | Dot Quality 5% | 50% | 95% |
|---|---|---|---|---|---|---|
| A | 100 | 16.0 | 0.01 | 3 | 2 | 3 |
| B | 65 | 17.0 | 0.01 | 2 | 2 | 2 |
| C | 120 | 17.5 | 0.01 | 2 | 1.5 | 2 |
| D | 110 | 14.0 | 0.03 | 4 | 3 | 4 |
| E | 102 | 14.5 | 0.01 | 3.5 | 3 | 4 |

The example shows that the known accelerator 2-mercapto-1-methyl-imidazole produces a poor dot quality, and L-cysteine does not accelerate at all.

EXAMPLE 5

A polyethylene terephthalate film support was coated with a sub coat of the following composition:

| | |
|---|---|
| 50 | parts gelatin |
| 3 | parts hydroquinone |
| 1 | part polyethylene glycol ether (TWEEN® 60R) |
| 200 | ml water |

An emulsion made in the manner described in Example 1, Sample A, was coated on top of this sub coat (the Control). Another emulsion made according to Example 1, Sample B (containing 2 mg/mole of silver halide of 2-amino-ethane-thiol-1-hydrochloride) was coated on another sample containing the same sub coat. Thus, 400 mg/mole of silver halide of the polyethylene glycol was present. Both samples were processed as previously described with the following results:

TABLE 5

| Sample | Relative Sensitivity (2 min. at 27° C.) | Fog | Dot Quality |
|---|---|---|---|
| A-control | 100 | 0.02 | 2 |
| B-of this invention | 128 | 0.02 | 2 |

This example demonstrates that 2-amino-ethanethiol-1-hydrochloride will accelerate without impairing dot quality.

EXAMPLE 6

Two identical roll developing machines (MI and MII) were set up and charged with the developer of Example 1. Samples of film similar to that of Example 4, Sample C of the invention, polyethylene glycol+2-amino-ethanethiol-1-hydrochloride, were exposed and processed in MI over a period of time as shown below while samples of film similar to that of Example 4, Sample D (the prior art acceleratorpolyethylene glycol+2-mercapto-1-methyl-imidazole) were exposed and processed in MII over the same periods of time. The following results were obtained.

TABLE 6

| Processor | Relative Sensitivity (2 min. at 27° C.) | Fog | Dot Quality |
|---|---|---|---|
| 1st Day | | | |
| MI | 100 | 0.01 | 2 |
| MII | 90 | 0.02 | 3 |
| 8th Day | | | |
| MI | 102 | 0.01 | 2 |
| MII | 92 | 0.02 | 3 |
| 14th Day | | | |
| MI | 97 | 0.02 | 2 |
| MII | 96 | 0.03 | 3.5 |
| 4 Weeks | | | |
| MI | 105 | 0.02 | 2 |
| MII | 101 | 0.04 | 4 |
| 8 Weeks | | | |
| MI | 103 | 0.03 | 2.5 |
| MII | 105 | 0.06 | 5 |

It is clear from this Example that film made according to the teachings of this invention does not show any deterioration in dot quality even in a used developer over a period of 2 months while film made using an accelerator of the prior art begins to show dot quality deterioration as soon as 14 days.

We claim:

1. A lithographic film element comprising a film support having one or more light-sensitive gelatino-silver halide emulsion layers coated thereon, each of which contains a development accelerator of the general formula:

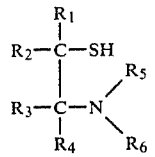

or a salt thereof, wherein each of $R_1$; and $R_2$ =H or $C_1$–$C_5$ alkyl, each of $R_3$ and $R_4$=H or −COOR, where R, $R_5$, and $R_6$=$C_1$–$C_5$ alkyl.

2. The lithographic film element of claim 1 wherein the development accelerator is 2-dimethylamino-ethanethiol-1 [cystein methyl ester, and their salts] or a salt thereof.

3. The lithographic film element of claims 1 or 2, wherein said element contains the development accelerator in combination with a dot sharpening agent selected from the group consisting of a polyalkylene oxide and a poly-N-vinyl lactam.

4. The lithographic film element of claim 2 in which the polyalkylene oxide is a polyethylene oxide having a molecular weight between 1,000 and 40,000.

5. The lithographic film element of claims 3 or 4, wherein the light-sensitive emulsion is coated in the form of a double coating with a thickness ratio between 1:1 and 1:9, and the dot sharpening agent is added to the thinnest of the emulsion layers.

6. The lithographic film element of one of the claims 1–5, wherein said element contains in the light-sensitive layer 50 to 500 mg hydroquinone per mole silver halide.

7. The lithographic film element of anyone of claims 3–6, wherein the development accelerator is in the light-sensitive layer and the polyalkylene oxide or poly-N-vinyl lactam is in an intermediate layer between the film base and the light-sensitive layer.

8. A lithographic film element consisting essentially of (a) a polyethylene terephthalate film support, (b) a light-sensitive gelatino-silver chlorobromide emulsion on said support, (c) an auxiliary underlayer between the film support and the emulsion, characterized in that the emulsion layer contains a development accelerator consisting of 2-dimethylamino-ethanethiol-1- or a salt thereof; and wherein the auxiliary underlayer contains a polyethylene oxide of M.W. circa 20,000, in an amount of sufficient to serve as a dot sharpening agent.

* * * * *

UNITED STATES PATENT OFFICE

CERTIFICATE OF CORRECTION

PATENT NO. : 4,230,796

DATED : October 28, 1980

INVENTOR(S) : Herbert Gunther and Herbert Blank

It is certified that error appears in the above-identified patent and that said Letters Patent are hereby corrected as shown below:

| Column | Line | | |
|---|---|---|---|
| 8 | 17 | (Claim 1) | Delete ; after "$R_1$" |
| 8 | 18 | (Claim 1) | "," after "alkyl" should be --;-- |
| 8 | 22 | (Claim 2) | Delete [cystein methyl ester, and their salts] |

Signed and Sealed this

*Nineteenth* Day of *May 1981*

[SEAL]

*Attest:*

RENE D. TEGTMEYER

*Attesting Officer*

*Acting Commissioner of Patents and Trademarks*